United States Patent [19]

Greenwald et al.

[11] 4,044,875

[45] Aug. 30, 1977

[54] REMOVABLE FUNNEL FOR A COIN OPERATED APPARATUS

[75] Inventors: Harry Greenwald, Whitestone; Salvatore Iglio, Valley Stream, both of N.Y.

[73] Assignee: Walter Kidde & Company, Inc., Clifton, N.J.

[21] Appl. No.: 695,763

[22] Filed: June 14, 1976

[51] Int. Cl.[2] ..... G07F 1/04

[52] U.S. Cl. ..... 194/1 K

[58] Field of Search ..... 194/1 K, 92, 93, 1 B; 133/1, 3 C, 3 D; 141/343, 340, 331; 46/2, 4, 5; 232/4 R, 55, 57

[56] References Cited

U.S. PATENT DOCUMENTS

| | | | |
|---|---|---|---|
| 1,510,631 | 10/1924 | Nutry | 141/340 X |
| 2,026,983 | 1/1936 | Long | 194/1 B X |
| 2,811,181 | 10/1957 | Correll | 141/340 |

*Primary Examiner*—Stanley H. Tollberg
*Attorney, Agent, or Firm*—McAulay, Fields, Fisher & Goldstein

[57] ABSTRACT

A removable funnel for a coin operated apparatus is disclosed which serves to catch coins deposited in the housing of the apparatus and direct said coins to a coin receiving location within said housing. The funnel is provided with hook members which engage with a support member positioned within the housing. Such engagement permits movement of the mounted funnel from a first position wherein the funnel is removable from the housing to a second position wherein the funnel is prevented from being removed therefrom. The funnel further includes a locking tab which projects through an opening in the support member, and which is disposed for bending movement from an unlocked position to a locked position when the mounted funnel is in its second position. The support member is provided with a blocking tab which is located to prevent bending movement of the locking tab to its locked position when the mounted funnel is in its first position. The location of the blocking tab is such that it also engages with the locking tab when the funnel is in its second position and the locking tab is bent to its locked position to thereby prevent movement of the funnel from its second position to its removable first position.

6 Claims, 7 Drawing Figures

REMOVABLE FUNNEL FOR A COIN OPERATED APPARATUS

BACKGROUND OF THE INVENTION

1. Field of the Invention

This invention relates generally to a coin operated apparatus, and more particularly, to a removable funnel for catching coins deposited in the apparatus and directing the coins to a coin receiving location.

2. Description of the Prior Art

Coin controlled or operated units are usually installed on commercial appliances; such as, clothes washers, dryers, vending machines and the like. The coin control is enclosed within a housing mounted on the appliance or machine, and the housing is usually provided with a locked coin drawer assembly which is intended to prevent unauthorized access to a coin receptacle or box removably supported within the housing. The coin controlled or operated apparatus comprises a guide track mounted on the housing, and a coin slide reciprocally supported in the guide track for projected and retracted movement. The coin slide has one or more coin receiving portions whereby insertion of the proper sum of coins therein permits projected movement of the coin slide within the housing to operate the appliance. In this regard, the inner end of the coin slide includes an actuator adapted to engage with a switch mechanism upon projected movement of the coin slide to its operate position; whereby movement of said switch is operable to connect the appliance in circuit with a source of energy for initiating the operating cycle of the appliance.

Heretofore, the deposited coins were transported under influence of gravity from the coin slide to the coin receiving location by means of a funnel fixedly mounted within the housing. Although it was possible for the operator to replace coin slide assemblies at the place of installation depending upon the size or selected value of the coins necessary to operate the apparatus, it was not possible to replace the funnel except by returning the entire housing to the manufacturer. In several instances, depending on the specific construction of the new coin slide assembly selected for replacement, it was necessary to also replace the funnel to provide the proper registry between the coin discharge opening of the coin slide assembly and the coin receiving location of the coin drawer assembly. This required that the appliance be taken out of service and that the coin operated apparatus be returned to the manufacturer for repair and/or replacement. It will be appreciated that considerable income may be lost to the operator during the period that the appliance is out of service due to the need to replace one or more components of the coin operated apparatus.

The present invention provides a novel funnel construction to permit and facilitate the convenient replacement thereof directly at the place of installation without having to return the coin operated apparatus and the associated housing to the manufacturer.

SUMMARY OF THE INVENTION

The proper sized funnel for use with the replaced coin slide assembly is selected by the operator to operatively interconnect the coin slide assembly with the coin drawer assembly. The invention provides for the funnel to be removably mounted on a support member suitably positioned within the housing. In this regard, interengaging mounting means are provided on the funnel and the support member to permit movement of the funnel from a first position wherein the funnel is removable from the support member to a second position wherein the funnel engages with the support member to prevent removal of the funnel therefrom. Interengaging locking means are also provided on the funnel and the support member to lock the funnel in its second position. Thus, at such time as it may be desirable to replace the funnel, it is only necessary to disengage the locking means to permit movement of the funnel to its removable first position. Movement of the funnel to its first position serves to disengage the mounting means whereupon the funnel may be removed from the support member and withdrawn from the housing.

Accordingly, an object of the present invention is to provide a removable funnel for use with a coin operated apparatus wherein the funnel may be quickly and easily installed by the operator directly at the place where the appliance is in use without having to return the apparatus to the manufacturer.

Another object and feature of the present invention is to provide a novel funnel construction which permits and facilitates the replacement thereof without having to take the associated appliance out of service for prolonged periods of time.

The above and other objects, features and advantages of the present invention will become more apparent from a consideration of the following detailed description when taken in conjunction with the accompanying drawings.

DESCRIPTION OF THE PREFERRED EMBODIMENT

Figure 1:
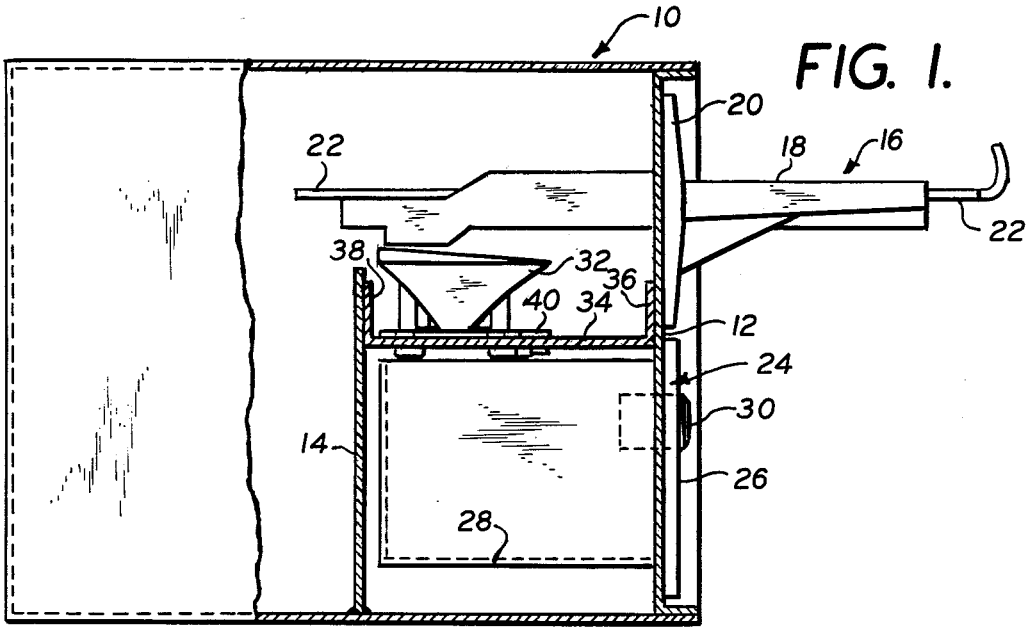
FIG. 1 is a side elevational view of the removable funnel constructed in accordance with the present invention, said funnel being mounted betwen the coin slide assembly and the coin drawer assembly.

Referring to the drawings, numeral 10 represents a housing for a coin operated apparatus which is adapted to be installed on a commercial appliance, such as, a clothes washer, dryer, vending machine or the like. Housing 10 is formed having a front wall 12 and an internal member 14, such as a partition or brace, in spaced preset parallel relation to wall 12. The upper surface portion of front wall 12 is illustrated as supporting a coin slide assembly 16 which includes a guide track 18 having an integrally formed faceplate 20 mounted to the front wall of the housing in conventional manner. Guide track 18 reciprocally supports a coin slide 22 for projected and retracted movement thereof. Coin slide 22 is formed having a coin receiving portion wherein the presence of one or more coins in the coin receiving portion permits projected movement of the coin slide 22 to its operate position within the housing. Such movement of the coin slide causes the inner end thereof to engage with a switch mechanism which serves to connect the appliance in circuit with a power source for initiating the operating cycle of the appliance.

The lower surface portion of front wall 12 is illustrated as supporting the coin box assembly 24 which includes a faceplate 26 formed integral with a coin box 28. A tumbler-type lock 30 is mounted in the faceplate 26 by which the coin box assembly 24 is latched or locked to the front wall of the housing.

Upon projected movement of coin slide 22, the coins are discharged through an opening in the undersurface of guide track 18 and are directed by means of a funnel member 32 to the coin box 28 located therebelow. In this regard, funnel 32 is mounted on a horizontal baffle or support member 34 having opposite ends 36 and 38 extending between front wall 12 and partition 14 and respectively connected thereto such as by welding or the like.

Figure 2:
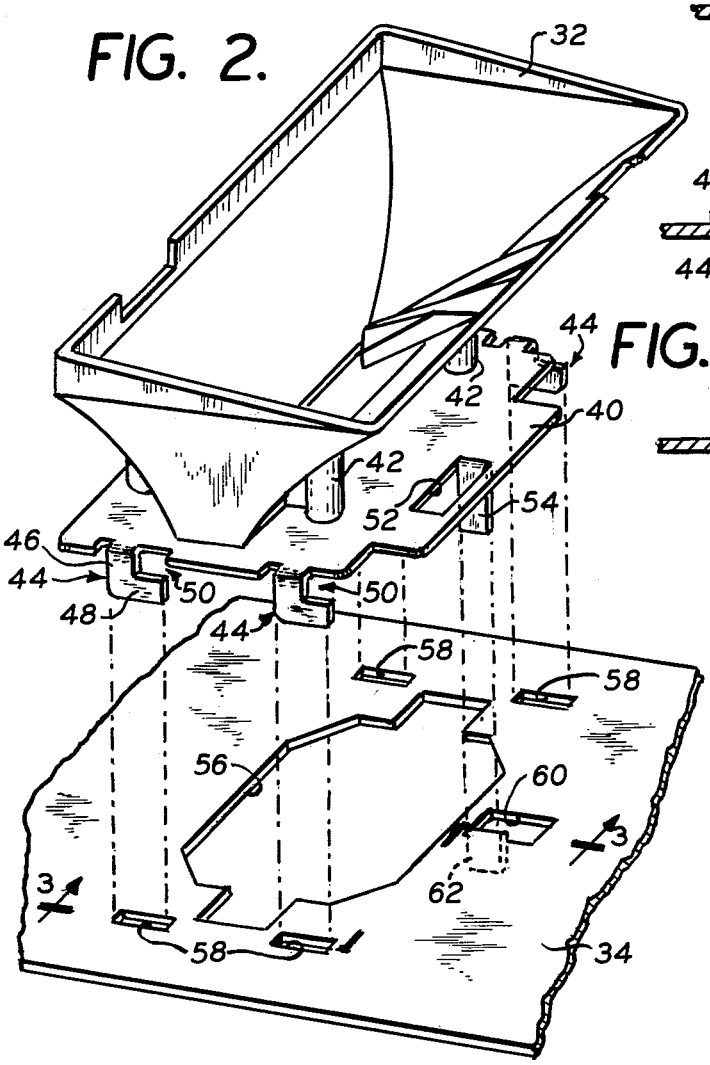
FIG. 2 is an exploded perspective view of the funnel and the associated support member on which the funnel is removably mounted.
Figure 3:
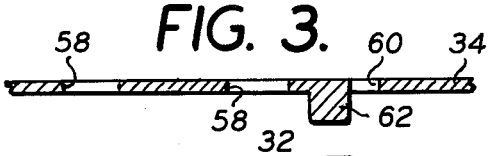
FIG. 3 is a sectional view taken through line 3—3 of the support member of FIG. 2.

Referring to FIG. 2, the discharge end of funnel 32 is suitably connected to a mounting plate 40 to facilitate mounting of the funnel on the support member 34. In this regard, a plurality of depending posts 42 are provided on funnel 32 each having terminal end portions which are frictionally received in accommodating openings (not shown) of plate 40 to form a unitary subassembly of said components. An elongated opening (not shown) is formed in plate 40 which opening is located in registry with the discharge opening of the funnel 32 so that coins discharged from the coin slide assembly 16 will pass through the funnel and the associated mounting plate 40.

Mounting plate 40 is formed having a plurality of hook members, represented generally by numeral 44, projecting downwardly from the bottom surface of the plate. Each of the hook members 44 is L-shaped having a depending portion 46 which terminates in a forwardly projecting portion 48. In the preferred embodiment, there are two hook members 44 connected to each of the side edges of plate 40. The arrangement is such that the space between hook portion 48 and the bottom surface of plate 40 defines a passageway, represented generally by numeral 50, for receiving therein an edge portion of support member 34 in the manner hereinafter described.

Figure 6:
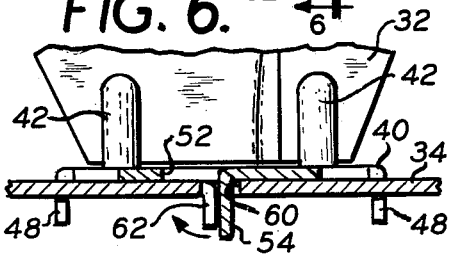
FIG. 6 is a sectional view taken through line 6—6 of FIG. 5.
Figure 7:
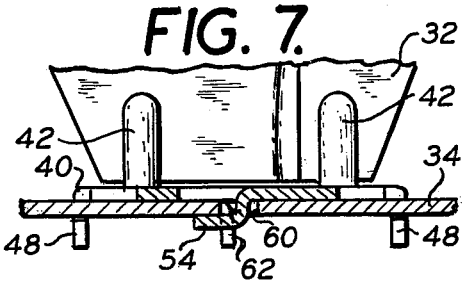
FIG. 7 is a view similar to FIG. 6 showing the locking tab moved to its locked position, in the direction of the arrow in FIG. 6, to lock the funnel in its second position.

Mounting plate 40 is further formed having a cut or stamped out portion 52 located adjacent the forward edge and approximately intermediate the side edges of the plate. Projecting downwardly from a side edge of plate opening 52 is a tab 54 disposed for bending movement from an unlocked position as shown in FIGS. 2 and 6 to a locked position as shown in FIG. 7 for locking the funnel in its mounted position on support member 34.

Support member 34 serves to separate the coin slide assembly 16 from the coin box 28. In this regard, support member 34, in combination with partition 14 and the side walls and bottom wall of housing 10, define a chamber for coin box 28 which is accessible through a suitable opening formed on the lower surface portion of housing front wall 12. Support member 34 is formed having an enlarged central opening 56, a portion of which is in registry with the aligned openings in funnel 32 and mounting plate 40 to permit coins to pass therethrough into coin box 28. The support member is further formed having a plurality of slotted openings 58 corresponding in number to the hook members 44 and aligned therewith whereby each one of said openings 58 is adapted to receive a separate one of said hook members 44 for mounting funnel 32 on support member 34. The thickness of support member 34 is slightly less than the corresponding dimension of passageways 50 to permit each of said passageways to frictionally receive therein a portion of the support member which defines the forward edge of opening 58 when the funnel is moved relative to the support member in the manner hereinafter described. The arrangement is such that hook member 44 and slotted openings 58 represent interengaging mounting means for removably mounting funnel 32 on support member 34, and permitting movement of funnel 32 from a first position as shown in FIG. 4 wherein said funnel is removable from said support member to a second position as shown in FIG. 5 wherein said funnel engages with said support member to prevent removal of the funnel therefrom.

Support member 34 is further formed with another slotted opening 60 located to receive mounting plate tab 54 when the funnel 32 is in its mounted position. Projecting downwardly from a side edge of support member opening 60 is another tab 62 which, in combination with tab 54, represent interengaging locking means to lock the funnel in its mounted position in the manner hereinafter described.

In operation, funnel 32 is removably mounted on support member 34 by means of the mounting plate hook members 44 which are received in the support member slotted openings 58, and with the mounting plate tab 54 received in the support member opening 60. This mounting arrangement is illustrated in FIG. 4 and represents the heretofore defined first position of funnel 32 relative to support member 34. It is to be noted that when funnel 32 is mounted in said first position, it is not possible to bend the locking tab 54 to its locked position in view of the blocking tab 62 which is positioned in the path of movement of locking tab 54.

Figure 4:
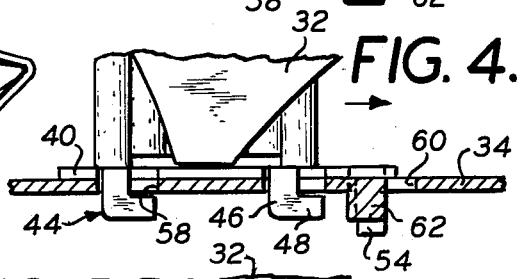
FIG. 4 is a view similar to FIG. 3 showing the lower portion of the funnel mounted on the support member in a removable first position.
Figure 5:
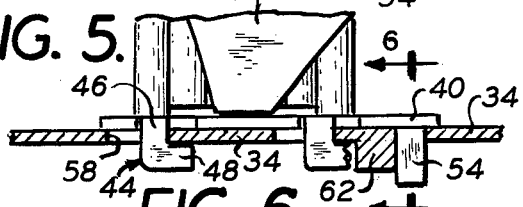
FIG. 5 is a view similar to FIG. 4 showing the funnel moved to a second position, in the direction of the arrow in FIG. 4, wherein the funnel is engaged with the support member to prevent removal of the funnel therefrom.

Funnel 32 may now be moved in the direction of the arrow in FIG. 4 to its second position, as shown in FIG. 5, whereby the portions of the support member which define the forward edge portions of slotted openings 58 are received in passageways 50. Funnel 32 is now in engagement with the support member 34 to prevent removal of the funnel therefrom. It is to be noted that when funnel 32 is moved to its second position, as shown in FIGS. 5 and 6, the locking tab 54 is now clear of blocking tab 62 and is ready to be moved to its locked position.

FIG. 7 shows the locking tab 54 bent in the direction of the arrow in FIG. 6 to its locked position whereby movement of funnel 32 back to its first position is prevented due to the engagement of bent locking tab 54 with blocking tab 62. In order to remove the funnel 32 from the support member 34, it is necessary to first move locking tab 54 to its unlocked position and then move the funnel 32 back to its first position to disengage the hook members 44 from said support member. Funnel 32 may now be lifted upwardly and withdrawn from the housing 10 through a suitable access opening in a wall of the housing.

It should be further noted that when funnel 32 is in its mounted position, the terminal end of locking tab 54 projects beyond support member opening 60 and into the coin receiving location which houses coin box 28. Thus, in order to bend locking tab 54 to its locked and unlocked positions, it is necessary to first disengage the lock 30 and remove the coin box 28 from the housing. In other words, only authorized personnel having the proper key to operate the lock 30 and thereby gain access to the coin receiving location can remove the existing funnel and replace the same with a different one to suit a specific application.

While a preferred embodiment of the invention has been shown and described in detail, it will be readily understood and appreciated that various changes or modifications thereof may be made without departing from the spirit and scope of the invention as set forth in the appended claims.

We claim:

1. A removable coin funnel for catching coins deposited in a housing of a coin operated apparatus and directing said coins to a coin receiving location within said housing, and in which the housing has a support plate formed having a plurality of slotted openings and a blocking tab, said funnel comprising:

a. mounting means for mounting said funnel in said housing and permitting movement of said mounted funnel between a first position wherein said funnel is removable from said housing and a second position wherein said funnel is prevented from being removed therefrom;

b. said mounting means comprising a plurality of hook members each projecting outwardly from said funnel and adapted to be received in a separate one of said support plate openings to permit said funnel to be removably mounted in its first position, each of said hook members having a portion spaced from said funnel to define a passage adapted to receive therein an edge portion of said support member defining the associated opening when said mounted funnel is moved to its second position in engagement with said support member; and, c. locking means disposed for bending movement from an unlocked position to a locked position when said funnel is in its second position d. said locking means comprising a tab member projecting outwardly from said funnel and adapted to be received in another one of said support plate openings when said funnel is mounted in its first position, said locking tab being adapted to engage with the blocking tab of said support plate when said funnel is in its second position and said locking tab is bent to its locked position to prevent movement of said funnel from its second position to its removable first position;

whereby said funnel is removable from said housing by moving said locking means to its unlocked position and then moving said funnel from its second position to its removable first position.

2. In combination with a coin operated apparatus having a housing, a support member mounted within said housing and a funnel mounted on said support member for catching coins deposited in said apparatus and directing said coins to a coin receiving location within said housing, wherein the improvement comprises;

a. interengaging mounting means on said funnel and said support member to permit movement of said mounted funnel from a first position wherein said funnel is removable from said support member to a second position wherein said funnel engages with said support member to prevent removal of said funnel therefrom;

b. said mounting means comprising a plurality of hook members each projecting outwardly from said funnel and a plurality of slotted openings formed in said support member; each one of said openings being aligned with a separate one of said hook members to permit said funnel to be removably mounted in its first position; each of said hook members having a portion spaced from said funnel to define a passage for receiving therein an edge portion of said support member defining the associated opening when said mounted funnel is moved to its second position in engagement with said support member; and, c. interengaging locking means on said funnel and said support member to lock said funnel in its second position;

d. said locking means comprising a tab member projecting outwardly from said funnel and an opening formed in said support member; said opening adapted to receive said tab member when said funnel is mounted on said support member in its first position; said tab member being disposed for bending movement from an unlocked position to a locked position when said funnel is in its second position; and, e. said locking means further comprising a blocking tab projecting outwardly from said support member, said blocking tab being located to prevent bending movement of said locking tab member to its locked position when said mounted funnel is in its first position, and to engage with said locking tab member when said funnel is in its second position and said locking tab member is bent to its locked position to prevent movement of said funnel from its second position to its removable first position;

whereby said funnel is removable from said support member by moving said locking means to its unlocked position and then moving said funnel from its second position to its first position to disengage said mounting means.

3. The invention as recited in claim 2, wherein said funnel has a mounting plate; and said hook members project outwardly from said plate.

4. The invention as recited in claim 3, wherein said mounting plate is located at the discharge end of said funnel; and said hook members project downwardly from the bottom surface of said plate.

5. The invention as recited in claim 2, wherein said support member is located between said funnel and said coin receiving location; said locking tab member projecting through the opening in said support member and being accessible in the coin receiving location for movement to its locked position.

6. In combination with a coin operated apparatus having a housing, a support member mounted within said housing and a funnel mounted on said support member for catching coins deposited in said apparatus and directing said coins to a coin receiving location within said housing, wherein the improvement comprises:

a. a mounting plate connected to the discharge end of said funnel;

b. a plurality of hook members projecting downwardly from the bottom surface of said plate;

c. said support member being located between said funnel and said coin receiving location, and being formed having a plurality of slotted openings;

d. each one of said openings being aligned with a separate one of said hook members to permit said funnel to be removably mounted on said support member in a first position;

e. each one of said hook members having a portion spaced from said mounting plate to define a passage for receiving therein an edge portion of said support member defining the associated opening and for permitting said mounted funnel to be moved to a second position in engagement with said support member to prevent removal of said funnel therefrom;

f. a tab member projecting downwardly from the bottom surface of said mounting plate;

g. said support member having another opening adapted to receive said tab member when said funnel is mounted on said support member in its first position;

h. said tab member projecting through the associated opening in said support member and being accessible in the coin receiving location for bending movement from an unlocked position to a locked position when said funnel is in its second position;

i. a second tab member projecting downwardly from the bottom surface of said support member, said second tab member being located to prevent bending movement of said first tab member to its locked position when said mounted funnel is in its first position, and to engage with said first tab member when said funnel is in its second position and said first tab member is bent to its locked position to prevent movement of said funnel from its second position to its removable first position;

whereby said funnel is removable from said support member by moving said first tab to its unlocked position and then moving said funnel to its first position to disengage said hook members from said support member.

* * * * *